US008746700B1

(12) United States Patent
Capone, Jr.

(10) Patent No.: US 8,746,700 B1
(45) Date of Patent: Jun. 10, 2014

(54) COIN WARS GAME SYSTEMS

(71) Applicant: Gregory Capone, Jr., South Amboy, NJ (US)

(72) Inventor: Gregory Capone, Jr., South Amboy, NJ (US)

( * ) Notice: Subject to any disclaimer, the term of this patent is extended or adjusted under 35 U.S.C. 154(b) by 20 days.

(21) Appl. No.: 13/655,438

(22) Filed: Oct. 18, 2012

Related U.S. Application Data

(60) Provisional application No. 61/585,426, filed on Jan. 11, 2012.

(51) Int. Cl.
*A63F 3/00* (2006.01)

(52) U.S. Cl.
USPC ..... 273/236; 273/408

(58) Field of Classification Search
USPC ..... 273/236, 336, 338, 339, 348, 348.3, 273/348.4, 348.5, 402, 408, 409; 473/478
See application file for complete search history.

(56) References Cited

U.S. PATENT DOCUMENTS

| | | | | |
|---|---|---|---|---|
| 4,902,011 | A * | 2/1990 | Seaton | 273/449 |
| 5,110,139 | A | 5/1992 | Baumgartner | |
| 5,282,635 | A | 2/1994 | Hopkins | |
| 7,731,196 | B2 * | 6/2010 | Scoccia | 273/348 |
| 2004/0227284 | A1 * | 11/2004 | Christianson | 273/126 R |
| 2008/0116644 | A1 | 5/2008 | Knoemschild | |
| 2011/0198811 | A1 * | 8/2011 | Wilheit, Jr. | 273/348 |
| 2012/0225739 | A1 * | 9/2012 | Cheshire et al. | 473/416 |

* cited by examiner

*Primary Examiner* — Vishu K. Mendiratta
(74) *Attorney, Agent, or Firm* — RG Patent Consulting, LLC; Rachel Gilboy

(57) ABSTRACT

Coin wars game systems is a coin toss game similar to a table game but played on a larger scale such as on a floor or outdoors. A board having a target or series of targets on its top side is placed on a flat surface and at least two participants toss coins at a target on the board, the target having a value graduated image, attempting to score the most points. Each participant has a card printed with instructions and commands. The participant also assumes the identity of the entity listed on the card with the given authority level, and the distance from the target that participant stands to toss the coins. The loosing participants must perform a predetermined number of repetitions of a given exercise after each round.

17 Claims, 5 Drawing Sheets

COIN WARS GAME SYSTEMS

CROSS-REFERENCE TO RELATED APPLICATION

The present application is related to and claims priority from prior provisional application Ser. No. 61/585,426, filed Jan. 11, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of games and more specifically relates to a coin tossing and exercising game.

2. Description of the Related Art

Tabletop game is a general term used to refer to board games, card games, dice games, miniatures war-games, tile-based games and other games that are normally played on a table top or other flat surface. The term is used to distinguish these types of games from sports and video games. The term is also used to distinguish role-playing games from role-playing video games, although role-playing games may not necessarily require a wide playing surface. Table games can also be divided into gambling and non-gambling categories. Table top games have been a part of American culture as well as part of other cultures for centuries. Table type games most often centered on gambling in earlier times and are still popularly employed in the gambling industry.

Families often play non-gambling type table games at family get-togethers and reunions as a tool for relaxing and bonding with other family members. Some families regularly play table games as a form of entertainment. Table games utilize a wide variety of devices, and combinations of devices, along with myriads of different rules. Some games are played on a larger scale and played on a larger area such as a floor or outside in a yard, but are still virtually a form of the table game. The thing that most all of the non-sport type games have in common is that they are more sedentary in nature though of a competitive nature. While entertaining, they may add to the health issues of average families, due to the amount of inactivity.

One of the biggest health issues of Americans in modem America is the pre-occupation with sedentary activities, compounded by high fat diets. A method of spurring families to exercise during periods of fun and enjoyment is needed for those not desiring or able to participate in the more highly physical sports activities is needed.

Various attempts have been made to solve the above-mentioned problems such as those found in U.S. Pat. Nos. 5,282, 635; 2008/0116644; and 5,110,139. This prior art is representative of object tossing games. None of the above inventions and patents, taken either singly or in combination, is seen to describe the invention as claimed.

Ideally, a non-sport game should require a greater amount of movement and physical activity, and, yet, be user-friendly and would operate reliably and be manufactured at a modest expense. Thus, a need exists for a reliable coin wars game system to provide a method of entertainment and bonding while receiving exercise, and to avoid the above-mentioned problems.

BRIEF SUMMARY OF THE INVENTION

In view of the foregoing disadvantages inherent in the known game art, the present invention provides a novel coin wars game system. The general purpose of the present invention, which will be described subsequently in greater detail, is to provide exercise and entertaining camaraderie during a game playing session.

In general terms, coin wars game systems is a coin toss game similar to a table game but played on a larger scale such as on a floor or outdoors. A board having a target or series of targets on its top side is placed on a flat surface and at least two participants toss coins at a target on the board, the target having a value graduated image; the participants each attempting to score the most points. Each participant has a card printed with instructions and commands. The participant also assumes the identity of the entity listed on the card with the given authority level, and the distance from the target that participant stands to toss the coins. The loosing participants must perform a predetermined number of repetitions of a given exercise after each round, thus promoting physical health of the players.

In greater detail, a coin wars game system, in a preferred embodiment, may comprise a game board and game piece assembly having a game board with a planer surface defined about its perimeter by a first edge, a second edge, and a third edge a fourth edge. The planer surface is further defined by a first side and a second side, the first side comprising an imprinted game-point pattern suitable for play thereon. A set of game coins may comprise at least one first-game-coin having a first-insignia, at least one second-game-coin having a second-insignia, at least one third-game-coin having a third-insignia, at least one fourth-game-coin having a fourth-insignia, at least one fifth-game-coin having a fifth-insignia, and at least one sixth-game-coin having a sixth-insignia. The coins are thus differentiated from each other for ease of recognition.

A plurality (at least six) playing cards, a folding measuring stick, and a tossing glove are also supplied. The first side of the game board is upwardly facing during a game when played and the second side is located oppositely and parallel-planar the first side such that the second side is in contact with a horizontal support surface such as a floor or the ground or table or the like. The first side of the game board comprises an imprinted game-point pattern such that the imprinted game-point pattern is non-removably adhered, the imprinted game-point pattern having a value graduated image. The game board may be laminated cardboard or may be plastic. The game board comprises the player's arena where the participants compete for highest score during the game. More than one game board may be used.

The arena(s) value graduated image comprises a target for participant scoring. The arena(s) are able to be folded flat and take up less space during non-play periods for storing. At least one first-game-coin is tossed by a first player onto the value graduated image during the game. At least one second-game-coin is tossed in succession by a second player, onto the value graduated image during the game. At least one third-game-coin is tossed in succession by a third player onto the value graduated image during the game. At least one fourth-game-coin is tossed in succession by a fourth player onto the value graduated image during the game. At least one fifth-game-coin is tossed in succession by a fifth player onto the value graduated image during the game and, at least one sixth-game-coin is tossed in succession by a sixth player onto the value graduated image during the game. This is the preferred order; however the order of sequence may be altered if desired.

The game board and game piece assembly is useful for a high-score game-competition between the first player, the second player, the third player, the fourth player, the fifth player, and the sixth player. There may be as few as two players during a game. A tossing glove is used for tossing the game coins onto the game board. Each of the first-game-coin, the second-game-coin, the third-game-coin, the fourth-game-coin, the fifth-game-coin, and the sixth-game-coin further may comprise three sizes each and may be made of plastic or rubber. The three sizes of game coins are about 1 inch, 2 inches, and 3 inches respectively. The first player, the second player, the third player, the fourth player, the fifth player, and the sixth player each are a game participant that plays the game in a respective, consecutive order.

Each of the participants of the game is also a card holder. Each of the playing cards further depict an authority figure to be assumed by the card holder, along with the authority level of the authority figure, during a played the game. The folding measuring stick is used to measure a distance between a participant and the game board and the other participants. The novel folding measuring stick is able to be folded compactly into a twelve inch ruler. The game board and game piece assembly is useful for playing a game of competition, the winner throwing his/her game coin at the highest value on the value graduated image. The losing participants are instructed to perform winning-participant-determined-exercises after each round played of the game. Determined-exercises may comprise for example push-ups, chin-ups, running, sit-ups and the like; all designed to improve player fitness. Many different forms of determined-exercises can be used. The playing cards comprise other instructions and commands. The instructions and commands provide a distance from which the player is to toss one of the game coins during play as measured by the folding measuring stick. Thus, the game of the present invention provides for physical and mental fitness, all in an entertaining format.

The coin wars game systems further may comprise a kit having at least one game board, at least one set of game coins, at least one said folding measuring stick, and at least one tossing glove. A method of use for the coin wars game systems may comprise determining a number of participants for a game session, providing game coins for each participant, drawing a card for each participant, playing a round of the game, and exercising by the non-winning participants as commanded by the winning participant as instructed from his/her card.

The present invention holds significant improvements and serves as a coin wars game system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, coin wars game systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a coin tossing game, and more particularly to a coin wars game system as used to improve the camaraderie and physical fitness of a social group.

Figure 1:
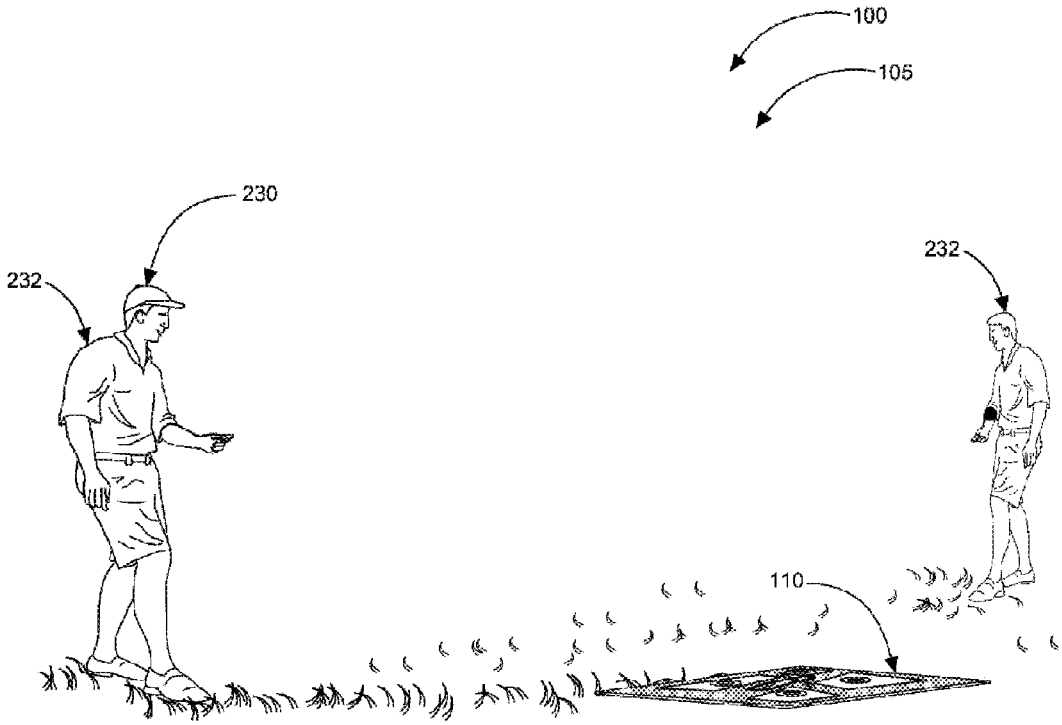
FIG. 1 shows a perspective view illustrating an in-use condition of a coin wars game system according to an embodiment of the present invention.

Referring to the drawings by numerals of reference there is shown in FIG. 1, a perspective view illustrating an in-use condition of coin wars game system 100 according to an embodiment of the present invention.

Coin wars game system 100 may comprise game board and game piece assembly 105 having game board 110 with a planer surface defined about its perimeter by first edge 112, second edge 114, third edge 116, and fourth edge 118. The planer surface is further defined by first side 120 and second side 122; first side 120 comprising imprinted game-point pattern 130.

Figure 4:
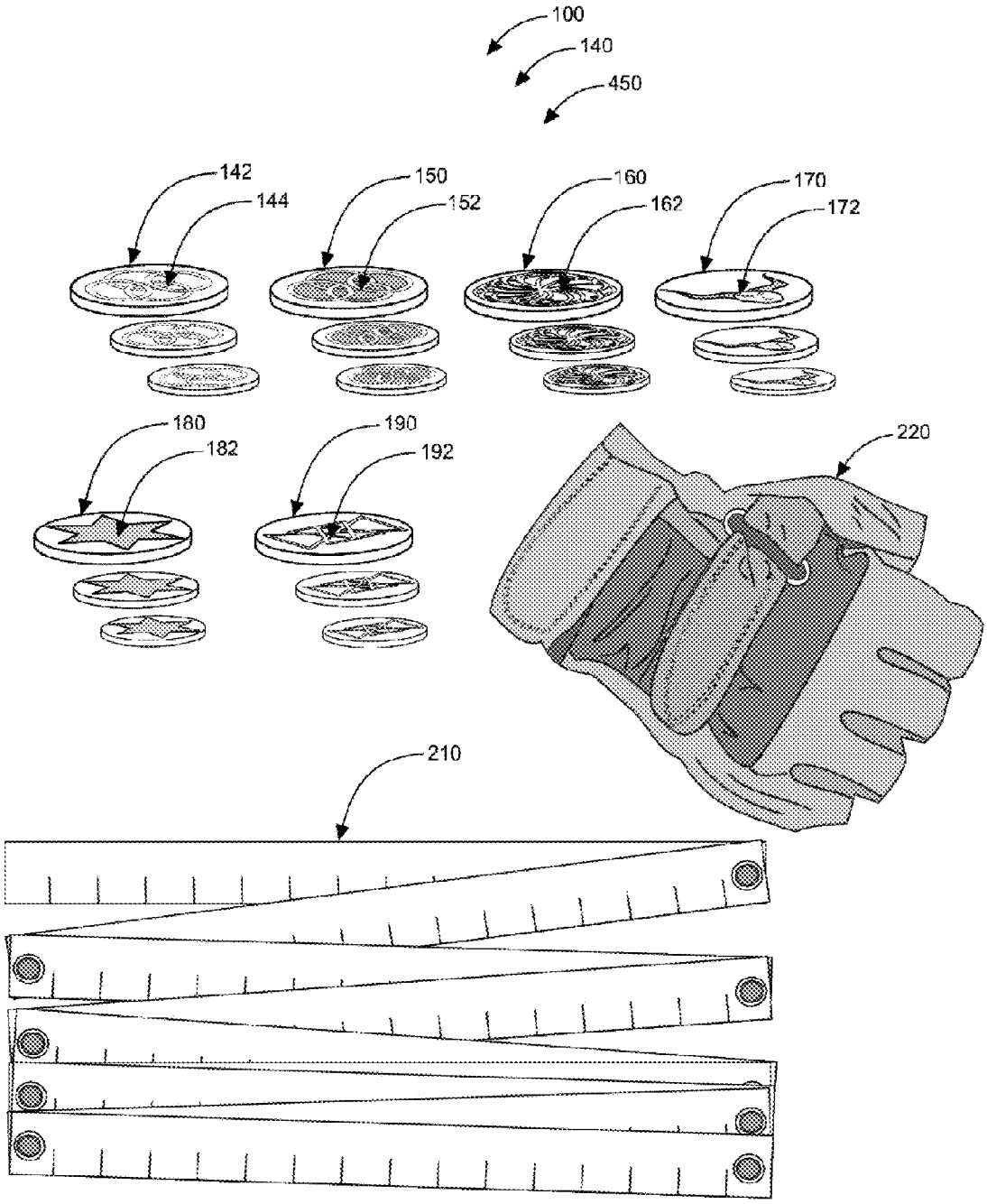
FIG. 4 is a perspective view illustrating various game coins, a folding ruler, and a tossing glove of the coin wars game system according to an embodiment of the present invention of FIG. 1.

The set of game coins 140 may comprise at least one first-game-coin 142 having first-insignia 144, at least one second-game-coin 150 having second-insignia 152, at least one third-game-coin 160 having third-insignia 162, at least one fourth-game-coin 170 having fourth-insignia 172, at least one fifth-game-coin 180 having fifth-insignia 182, and at least one sixth-game-coin 190 having sixth-insignia 192. At least six playing cards 200, folding measuring stick 210, and tossing glove 220 are also supplied, as shown in FIG. 4. Game board and game piece assembly 105 is useful for a high-score game-competition between a first player(s) 230, a second player(s) 230, a third player(s) 230, a fourth player(s) 230, a fifth player(s) 230, and a sixth player(s) 230. There may be as few as two player(s) 230 during a game session. The present inventive game serves to promote physical exercise in an entertaining format.

Figure 2:
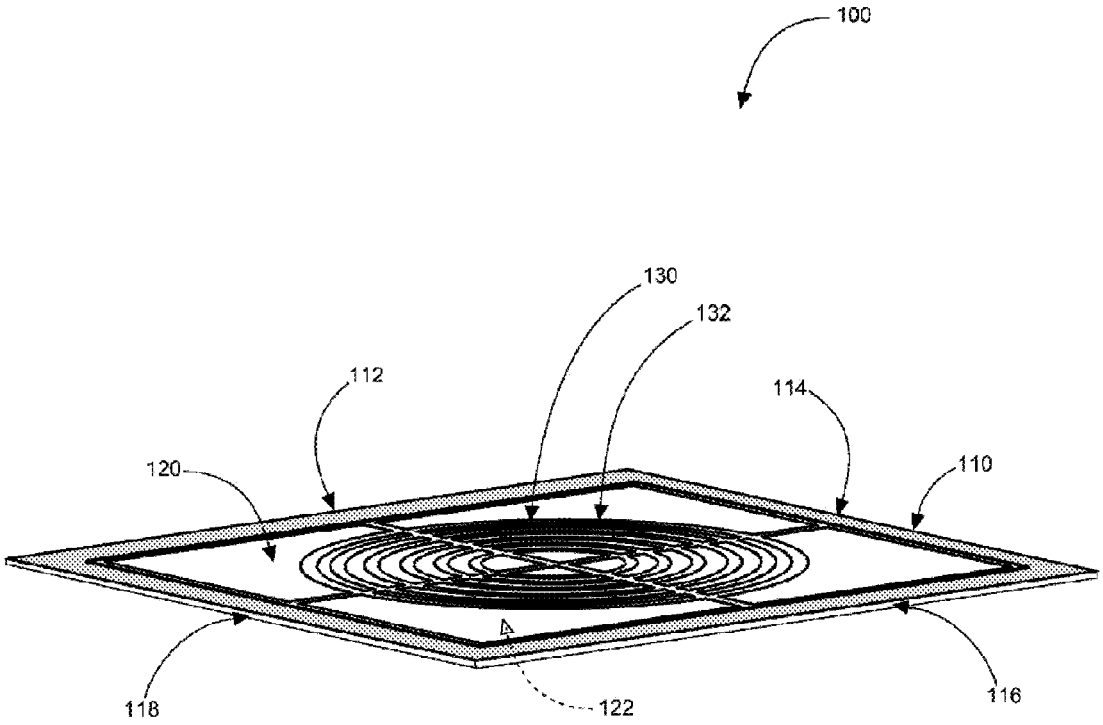
FIG. 2 is a perspective view illustrating a game board of the coin wars game system, according to an embodiment of the present invention of FIG. 1.

Referring now to FIG. 2, a perspective view illustrating game board 110 of coin wars game system 100, according to an embodiment of the present invention of FIG. 1.

First side 120 of game board 110 is upwardly facing during a game when played and second side 122 is located oppositely and parallel-planar to first side 120 such that second side 122 is in contact with a horizontal support surface such as the ground or the like. First side 120 of game board 110 comprises imprinted game-point pattern 130 such that imprinted game-point pattern 130 is non-removably adhered to first side 120 of game board 110; imprinted game-point pattern 130 having value graduated image 132. Game board 110 may be laminated cardboard or may be plastic. Game board 110 is player(s) 230 arena where participants compete for highest score during a game. More than one game board 110 may be used. The arena(s) value graduated image 132 comprises a target for participant 232 scoring. Game board 110, which is the arena(s), is able to be folded flat and smaller during non-play periods for storing.

Figure 3:
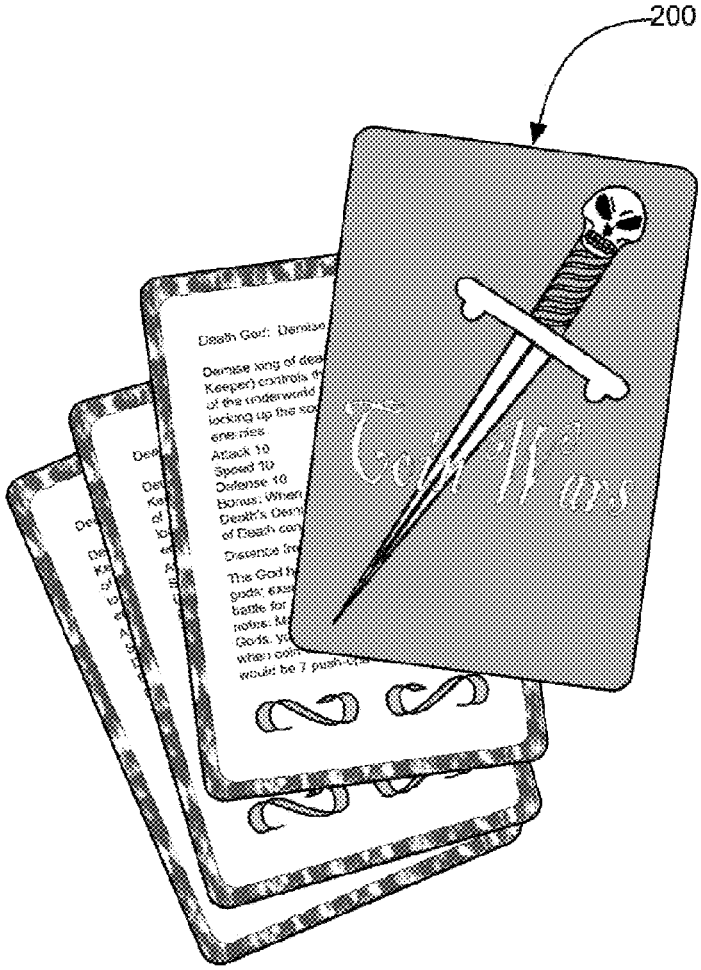
FIG. 3 is a perspective view illustrating playing cards of the coin wars game system according to an embodiment of the present invention of FIG. 1.

Referring now to FIG. 3, a perspective view illustrating playing card(s) 200 of coin wars game system 100 according to an embodiment of the present invention of FIG. 1. Game board and game piece assembly 105 is useful for playing a game of competition, the winner throwing his/her game coin(s) 140 at the highest value on value graduated image 132. The losing participant(s) 232 are instructed to perform winning-participant-determined-exercises after each round played of the game. Playing card(s) 200 comprise other instructions and commands. The instructions and commands provide a distance from which player(s) 230 are to toss one of game coin(s) 140 during play as measured by folding measuring stick 210.

Referring now to FIG. 4, a perspective view illustrating various game coin(s) 140, folding measuring stick 210, and tossing glove 220 of coin wars game system 100 according to an embodiment of the present invention of FIG. 1.

At least one first-game-coin 142 is tossed by a first player(s) 230 onto value graduated image 132 during the game. At least one second-game-coin 150 is tossed in succession by a second player(s) 230, onto the value graduated image 132 during the game. At least one third-game-coin 160 is tossed in succession by a third player(s) 230 onto value graduated image 132 during the game. At least one fourth-game-coin 170 is tossed in succession by a fourth player(s) 230 onto value graduated image 132 during the game. At least one fifth-game-coin 180 is tossed in succession by a fifth player(s) 230 onto value graduated image 132 during the game and, at least one sixth-game-coin 190 is tossed in succession by a sixth player(s) 230 onto the value graduated image 132 during the game. More or less players 230 may play gave, thus increasing or decreasing how many game coin(s) 140 are used.

Tossing glove 220 is used for tossing game coin(s) 140 onto game board 110. Each of first-game-coin 142, second-game-coin 150, third-game-coin 160, fourth-game-coin 170, fifth-game-coin 180, and sixth-game-coin 190 further may comprise three sizes each and may be made of plastic or rubber. There may be three sizes of game coin(s) 140 that are about 1 inch, 2 inches, and 3 inches respectively. The first player(s) 230, second player(s) 230, third player(s) 230, fourth player(s) 230, fifth player(s) 230, and player(s) 230 each are a game participant(s) 232 that plays the game in a respective, consecutive order. Each of participant(s) 232 of the game are also a card holder. Each of playing card(s) 200 further depict an authority entity to be assumed by the card holder, along with the authority level of the authority figure, during a played game. Folding measuring stick 210 is used to measure a distance between participant(s) 232 and game board 110 and other participant(s) 232. Folding measuring stick 210 is able to be folded compactly into a twelve inch ruler.

Coin wars game system 100 may be sold as kit 450 comprising the following parts: at least one game board 110; at least one set of game coin(s) 140; at least one folding measuring stick 210; at least one tossing glove 220; and at least one set of user instructions. Coin wars game system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different coin combinations, parts may be sold separately, etc., may be sufficient.

Figure 5:
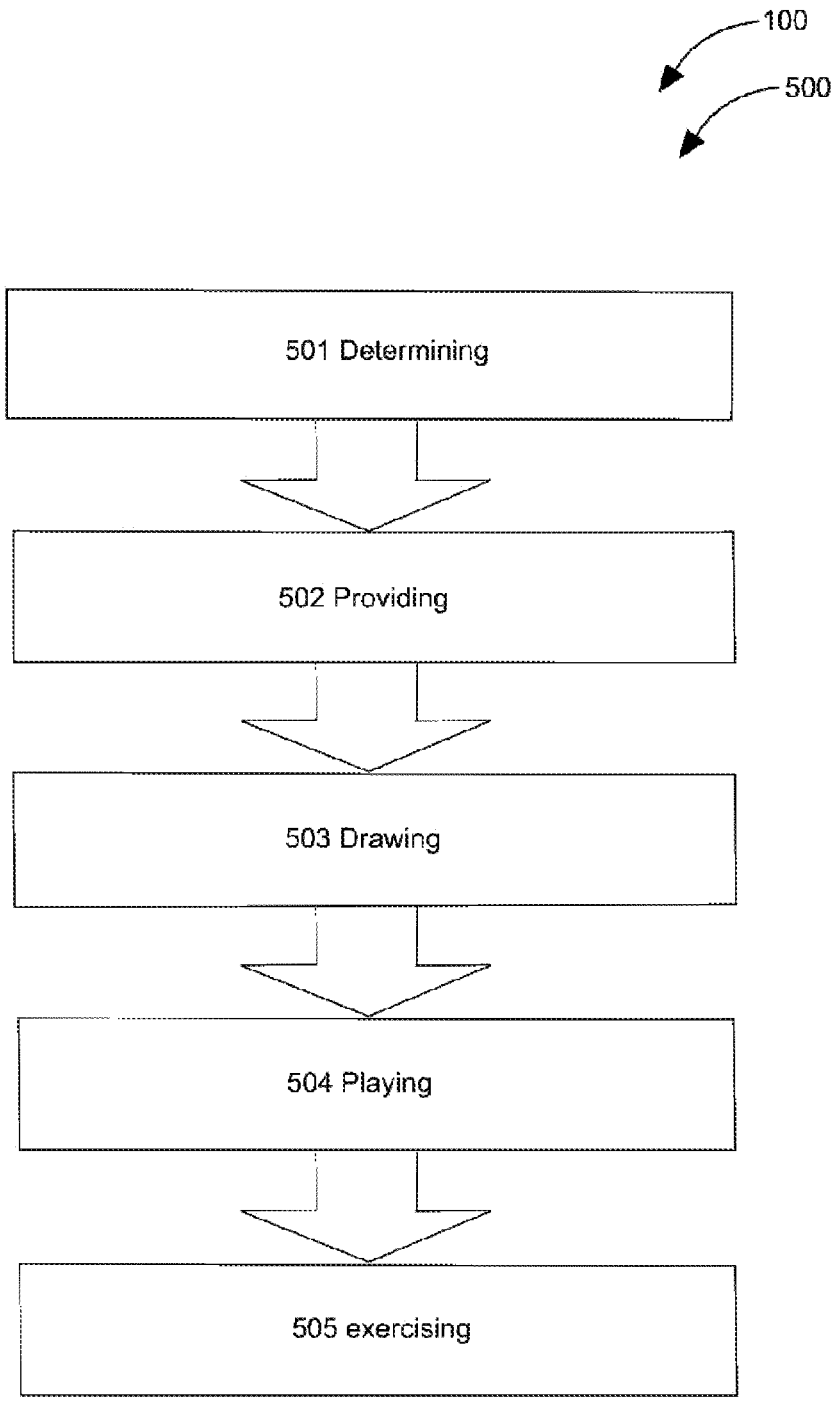
FIG. 5 is a flowchart illustrating a method of use for the coin wars game system according to an embodiment of the present invention of FIG. 1.

Referring now to FIG. 5, method of use 500 for coin wars game system 100 may comprise the steps of: step one 501, determining a number of participant(s) 232 for a game session; step two 502, providing game coin(s) 140 for each of participant(s) 232; step three 503, drawing playing card(s) 200 for each participant(s) 232; step four 504, playing a round of the game; step five 505, exercising by the non-winning participant(s) 232 as commanded by the winning participant(s) 232 according to card instructions.

It should be noted that step 505 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A coin wars game systems comprising:

a game board and game piece assembly comprising;

a game board with a planer surface defined about its perimeter by a first edge, a second edge, a third edge, a fourth edge, said planer surface is further defined by a having a first side and a second side, said first side comprising an imprinted game-point pattern thereon;

a set of game coins comprising;

at least one first-game-coin having a first-insignia;

at least one second-game-coin having a second-insignia;

at least one third-game-coin having a third-insignia;

at least one fourth-game-coin having a fourth-insignia;

at least one fifth-game-coin having a fifth-insignia;

at least one sixth-game-coin having a sixth-insignia;

at least six playing cards;

a folding measuring stick; and a tossing glove; and wherein said first side of said game board is upwardly facing during a game when played and said second side is located oppositely and parallel-planar said first side such that said second side is in contact with a horizontal support surface;

wherein said first side of said game board comprises said imprinted game-point pattern such that said imprinted game-point pattern is non-removably adhered to said first side and wherein said imprinted game-point pattern comprises a value graduated image;

wherein said at least one first-game-coin is tossed by a first player onto said value graduated image during said game;

wherein said at least one second-game-coin is tossed in succession by a second player onto said value graduated image during said game;

wherein said at least one third-game-coin is tossed in succession by a third player onto said value graduated image during said game;

wherein said at least one fourth-game-coin is tossed in succession by a fourth player onto said value graduated image during said game;

wherein said at least one fifth-game-coin is tossed in succession by a fifth player onto said value graduated image during said game;

wherein said at least one sixth-game-coin is tossed in succession by a sixth player onto said value graduated image during said game;

wherein said game board and game piece assembly is useful for a high-score game-competition between said first player, said second player, said third player, said fourth player, said fifth player, and said sixth player;

wherein said tossing glove is used for tossing said game coins onto said game board;

wherein said first player, said second player, said third player, said fourth player, said fifth player, and said sixth player each comprise a game participant, said participants playing in a respective order during said game;

wherein said folding measuring stick is used to measure a distance between a participant and said game board; and wherein said game board and game piece assembly is useful for playing said game of competition, a winner throwing his/her said game coin on a highest value on said value graduated image, losing said participants performing winning-participant-determined-exercises during said game.

2. The coin wars game systems of claim 1 wherein said game board comprises at least one arena.

3. The coin wars game systems of claim 2 further comprising at least two arenas, said arenas able to be folded flat during non-play periods.

4. The coin wars game systems of claim 2 wherein said arena(s) comprises a target.

5. The coin wars game systems of claim 1 wherein said playing cards comprise instructions and commands.

6. The coin wars game systems of claim 5 wherein said instructions and commands provide a distance from which said player is to toss one of said game coins during play measured by said folding measuring stick.

7. The coin wars game systems of claim 6 wherein said folding measuring stick is able to be folded into a twelve inch ruler.

8. The coin wars game systems of claim 7 wherein said measuring stick is used to measure a distance between said participants during said game.

9. The coin wars game systems of claim 5 wherein each of said playing cards further comprise an authority figure to be assumed by said card holder, said authority figure having an authority level during a played said game.

10. The coin wars game systems of claim 9 wherein said playing cards further comprise an exercise command for said non-winning participants to perform after each round played of said game.

11. The coin wars game systems of claim 1 wherein each of said participants of said game are a card holder.

12. The coin wars game systems of claim 1 wherein each of said first-game-coin, said second-game-coin, said third-game-coin, said fourth-game-coin, said fifth-game-coin, and said sixth-game-coin further comprise three sizes each.

13. The coin wars game systems of claim 12 wherein said three sizes each of said first-game-coin, said second-game-coin, said third-game-coin, said fourth-game-coin, said fifth-game-coin, and said sixth-game-coin are about 1 inch, 2 inches, and 3 inches respectively.

14. The coin wars game systems of claim 1 wherein said game is played by at least two of said participants.

15. The coin wars game systems of claim 1 wherein said value graduated image is said arena and wherein said participants compete on said arena for highest score during said game.

16. The coin wars game systems of claim 1 wherein said game board is laminated cardboard.

17. The coin wars game systems of claim 1 wherein said game coins comprise plastic.

* * * * *